US005775893A

United States Patent [19]

Takao et al.

[11] Patent Number: 5,775,893

[45] Date of Patent: Jul. 7, 1998

[54] SCROLL COMPRESSOR HAVING AN ORBITING SCROLL WITH VOLUTE WRAPS ON BOTH SIDES OF A PLATE

[75] Inventors: Kunihiko Takao; Masahiro Takebayashi, both of Tsuchiura; Yoshishige Endo, Tsuchiura; Yuji Yoshitomi, Ibaraki-ken; Shigeru Machida, Ibaraki-ken; Kenji Tojo, Ibaraki-ken; Kazuo Sekigami, Tochigi-ken, all of Japan

[73] Assignee: Hitachi, Ltd., Tokyo, Japan

[21] Appl. No.: 665,984

[22] Filed: Jun. 19, 1996

[30] Foreign Application Priority Data

Jun. 20, 1995 [JP] Japan ..... 07-153529

[51] Int. Cl.[6] ..... F04C 18/04

[52] U.S. Cl. ..... 418/55.2; 418/55.3; 418/60; 418/151

[58] Field of Search ..... 418/55.2, 55.3, 418/60, 151

[56] References Cited

U.S. PATENT DOCUMENTS 5,304,047 4/1994 Shibamoto ..... 418/55.2

FOREIGN PATENT DOCUMENTS 1138387 5/1989 Japan ..... 418/55.2
4269301 9/1992 Japan ..... 418/55.2
5187372 7/1993 Japan .
6-10601 1/1994 Japan ..... 418/55.2
6101666 4/1994 Japan ..... 418/55.2

*Primary Examiner*—John J. Vrablik

*Attorney, Agent, or Firm*—Antonelli, Terry, Stout & Kraus, LLP

[57] ABSTRACT

Fixed scrolls 4, 5 are supported so to be movable axially relative to an orbiting scroll 6, so that a proper space is kept between wraps 4*a*, 5*a* and 6*a* to avoid an excessive load in the contacting area. Further, an end portion of an outer curve of the wrap 6*a* of the orbiting scroll 6 is formed to come close to or coincide to an outer edge of a panel 6*f* of the orbiting scroll 6 and an Oldham's coupling is accommodated in a concave groove 6*e* formed on an outer circumference surface of the panel 6*f*, so that the size of the scroll compressor is reduced.

7 Claims, 8 Drawing Sheets

SCROLL COMPRESSOR HAVING AN ORBITING SCROLL WITH VOLUTE WRAPS ON BOTH SIDES OF A PLATE

BACKGROUND OF THE INVENTION

1. Field of the Invention

This invention relates to a scroll compressor used in refrigerated air conditioners, air compressors and such. More particularly, it relates to a scroll compressor which includes an orbiting scroll having wraps on both sides of a flat plate and a drive shaft for rotating the orbiting scroll extended through the orbiting scroll and fixed scrolls.

2. Description of Related Art

Such a scroll compressor is disclosed in Japanese Patent Unexamined Publication No. 5-187372, which includes an orbiting scroll having involute wraps on both sides of the flat plate (panel), a pair of fixed scrolls each having an involute wrap fitted to the corresponding involute wrap of the orbiting scroll, a spindle provided through the orbiting scroll and the fixed scrolls for rotating (orbiting) the orbiting scroll, three driven crank-shafts for preventing the orbiting scroll from turning on its axis and provided equiangularly of 120° on an outer side of wrap formed space, and bearings.

This publication also teaches that a groove with a self-lubricating seal (tip seal) put therein is provided on an end surface opposite to the panel of the mating scroll so that the wrap end surface and the mating scroll can slidably contact with each other through the tip seal.

Another conventional scroll compressor is disclosed in Japanese Patent Unexamined Publication No. 1-138387, which is constituted such that, similarly to the above described compressor, an orbiting scroll is disposed between a pair of fixed scrolls, and a compression spring is arranged in a slide hole on the end plate of the orbiting scroll to prevent the orbiting scroll from turning on its axis. For this reason, the orbiting scroll can reciprocate in an X-axial direction due to the spring force pressing down a pin to a casing. On the other hand, a slide way is formed on the casing along a direction vertical to the pin, so that a side plate provided between the pin and the casing can move in a y-axial direction. Thus, the orbiting scroll is prevented from turning on its axis.

With the former conventional scroll compressor, however, the volute wraps are required to start winding from outside since the spindle extends through the center of the scroll. As the minimum air-holding room defined by the wraps of involute or other curve spreads externally, the volume thereof increases, so that the number of turns of the wrap needs increasing externally to secure a predetermined compression ratio (corresponding to a ratio of a volume in a compression chamber at the beginning of the compression to that at the beginning of the discharge), thereby increasing the size (diameter) of the scroll.

Also, a turning preventing mechanism for preventing the orbiting scroll from turning on its axis is formed in the outer edge portion of the panel projecting externally from the end of wound-up wrap, and this makes the shape of the compressor further large. Accordingly, it has been impossible in a scroll compressor for a refrigerated air conditioner to reduce the size (diameter) to 160 mm or less with a power rating of 5 hp.

Further, the panel of the orbiting scroll is relatively thick to make the full weight of the orbiting scroll heavy, so that the bearing load is increased due to centrifugal force as the orbiting scroll is rotated, thereby increasing vibrations.

Furthermore, since the wrap end surface and the mating scroll are slidably in contact with each other through the tip seal, the wear resistance of the chip seal significantly affects the efficiency and reliability of the scroll compressor.

On the other hand, the latter conventional scroll compressor has the advantage of reducing the size since the turning preventing mechanism is provided on the end plate of the orbiting scroll, but other problem arises that the spring force creates vibrations during operation of the compressor.

In other words, the turning preventing mechanism has a resonance system in the X-axial direction. Since the resonance is controlled based on the mass of the orbiting scroll and the motor speed, the motor must suppress the resonance as well as rotate the orbiting scroll. Accordingly, the latter scroll compressor has the disadvantage of creating vibrations together with motor revolutions. Another problem with this case is the low reliability of the spring.

SUMMARY OF THE INVENTION

The present invention has been accomplished under the circumstances as aforementioned, and an object thereof is to provide a compact scroll compressor with high performance and reliability. This is shown by preferred embodiments in which an orbiting scroll is reduced to a suitable size for high-speed operation, so that power control can be carried out in a wide range while maintaining gentle operation.

The above object of the present invention is attained by the provision of a scroll compressor which includes an orbiting scroll having volute wraps on both sides of a flat plate; fixed scrolls arranged on the both sides of the orbiting scroll, each having a wrap paired face to face with the corresponding wrap of the orbiting scroll; and a drive shaft provided through the orbiting scroll and the fixed scrolls for rotating the orbiting scroll inside the fixed scrolls, in which the orbiting scroll is rotated while being prevented from turning round the fixed scrolls so that a gas can be compressed, characterized in that an end of an outer curve of each wrap of the orbiting scroll comes close to or coincides to the outer edge of the flat plate, and a concave groove is formed on the outer surface of the flat plate, and an Oldham's coupling is accommodated in the concave groove and engaged with the orbiting scroll.

In an aspect of the present invention, an end portion of an outer curve of each wraps of the orbiting scroll comes close to or coincides to an outer edge of the flat plate, and an Oldham's coupling is divided into two parts at a center of key portions and the divided parts are arranged to face each other.

In another aspect of the present invention, the orbiting scroll is axially divided into two members at a center of the flat panel and the divided members are arranged to be opposite to each other.

Then, elastic members capable of axial expansion and contraction are arranged between the divided faces of the orbiting scroll, and an Oldham's coupling is accommodated in a concave groove formed in edge portions of outer circumferential surface of the divided faces and engaged with the orbiting scroll so that the orbiting scroll can be rotated while being prevented from turning on its axis.

Further, the scroll compressor according to the present invention is reduced to a diameter of 160 mm or less with a power rating of 5 hp.

According to the present invention, an end portion of an outer curve of each wrap of the orbiting scroll comes close to or coincides to an outer edge of the flat plate (panel) in the last turn portion, so that the panel size of the orbiting scroll can be reduced. Since the Oldham's coupling is divided into two parts at the center of the key width and slidably accommodated in the concave groove formed in the outer circumferential surface of the orbiting scroll panel, the size of the compressor can be also reduced.

Accordingly, it is possible to reduce the diameter of the compressor to 160 mm or less with a power rating of 5 hp.

Further, since no spring is used in the turning preventing mechanism, gentle operation can be performed without vibration.

BRIEF DESCRIPTION OF THE DRAWINGS

The above and other objects and advantages and further description will now be described in connection with the drawings, in which.

DETAILED DESCRIPTION OF THE PREFERRED EMBODIMENTS

Figure 1:
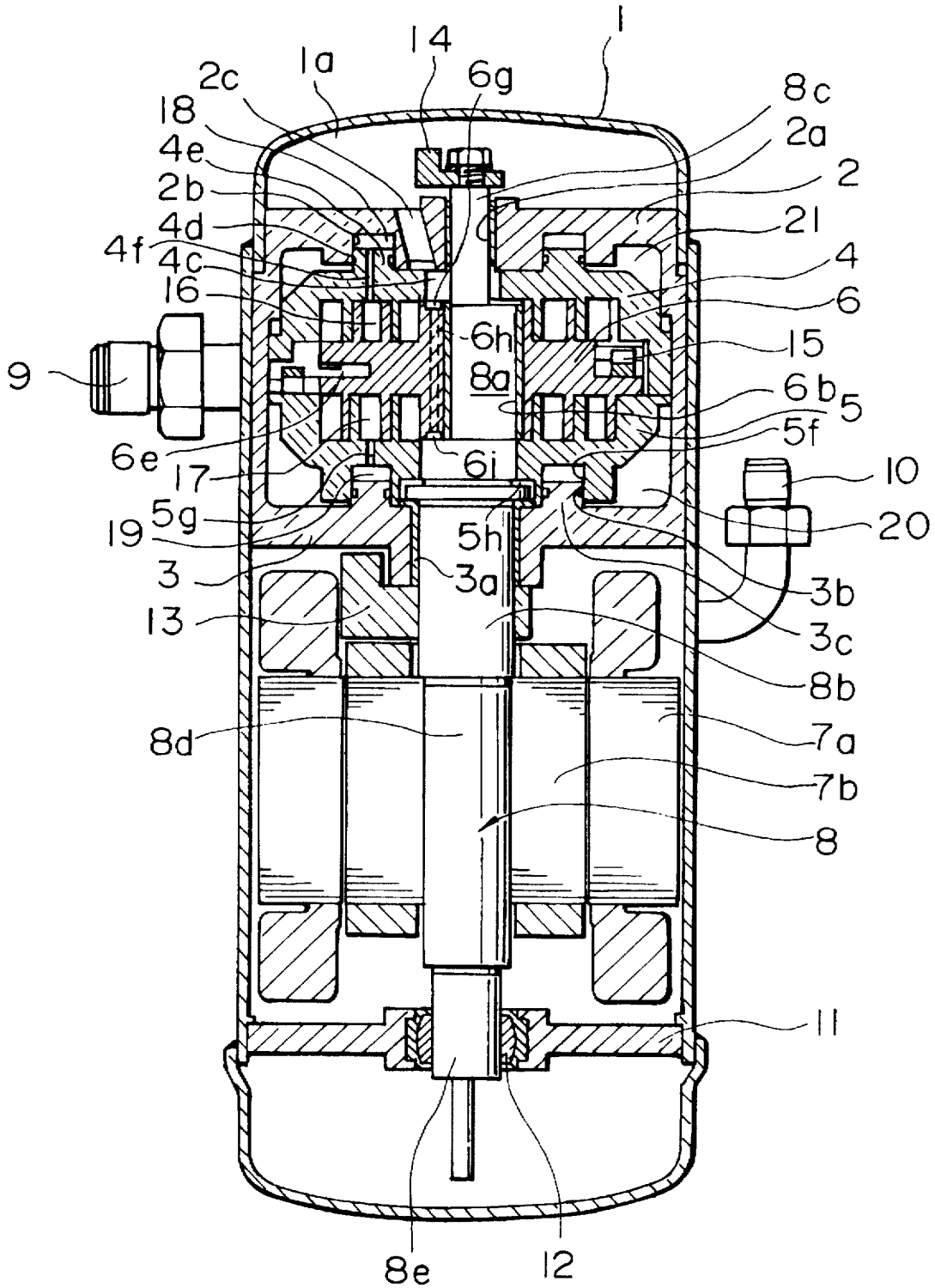
FIG. 1 is a vertical sectional view showing a first embodiment of a scroll compressor accordding to the present invention.

Referring to the drawings, embodiments of the present invention will be described below.

In FIG. 1, a scroll compressor includes: a closed container 1 of cylindrical shape with the top and bottom ends sealed and its axis being substantially vertical to the ground; first and second frames 2, 3 fixed in an upper portion of the closed container 1 with their axes aligned with that of the closed container 1; first and second fixed scrolls 4, 5 slidably mounted inside the first and second frames 2, 3 with their axes aligned with those of the first and second frames, each fixed scroll having a volute wrap on one side so that the upper and lower wraps are opposite to each other; an orbiting scroll 6 having volute wraps symmetrically on the both sides of a flat plate and rotatably mounted inside between the fixed scrolls 4, 5; an orbiting scroll driving motor, composed of a stator 7*a* and a rotor 7*b*, provided below the second frame 3 with its axis aligned with those of the first and second fixed scrolls 4, 5; a crank shaft 8 coupled with the rotor 7*b* and rotated by the rotor 7*b* so that the orbiting scroll 6 can be rotated by the crank shaft 8 through a swing bearing 6*b*; a suction pipe 9 provided through the side wall of the closed container 1 for supplying a space with a gas to be compressed, the space defined by the wrap of the first fixed scroll 4 and the wrap of the orbiting scroll 6; and a discharge pipe 10 provided through the side wall of the closed container 1.

The second frame 3 is fixed on the side wall of the closed container 1, and the first frame 2 is fastened to the second frame 3 with a bolt through the first frame 2 and the first and second fixed scrolls 4, 5.

The crank shaft or drive shaft 8 is constituted of: a rotor coupling portion 8*d* coupled with the rotor 7*b*; a lower supporting shaft portion 8*b* extending upwardly from the top of the rotor coupling portion 8*d* and held by a second frame bearing 3*a* in the center of the second frame 3; an eccentric shaft portion 8*a* extending upwardly from the top of the lower supporting shaft portion 8*b* and fitted into the swing bearing 6*b*; an upper supporting shaft portion 8*c* extending upwardly from the top of the eccentric shaft portion 8*a* and held by a first frame bearing 2*a* fixed at the center of the first frame 2; and a lower-end supporting shaft portion 8*e* extending downwardly from the bottom of the rotor coupling portion 8*d* and held by an auxiliary bearing 12 fixed in an auxiliary frame 11 fixed on the side wall of the closed container 1.

The crank shaft 8 further includes a lower balance weight 13 and an upper balance weight 14 mounted around the lower supporting shaft portion 8*b* and the upper supporting shaft portion 8*c*, respectively, so that centrifugal force of the orbiting scroll 6 and the moment by the centrifugal force are canceled, thereby preventing vibrations. It should be noted that the second frame bearing 3*a* is provided with a collar for supporting the total weight of the crank shaft 8 and the rotor 7*b*.

The orbiting scroll 6 is prevented by an Oldham's coupling 15 from turning on its axis, i.e., rotation centering the eccentric shaft portion 8*a*, so that the rotation of the eccentric shaft portion 8*a* provides an orbiting motion to the orbiting scroll 6.

Figure 2:
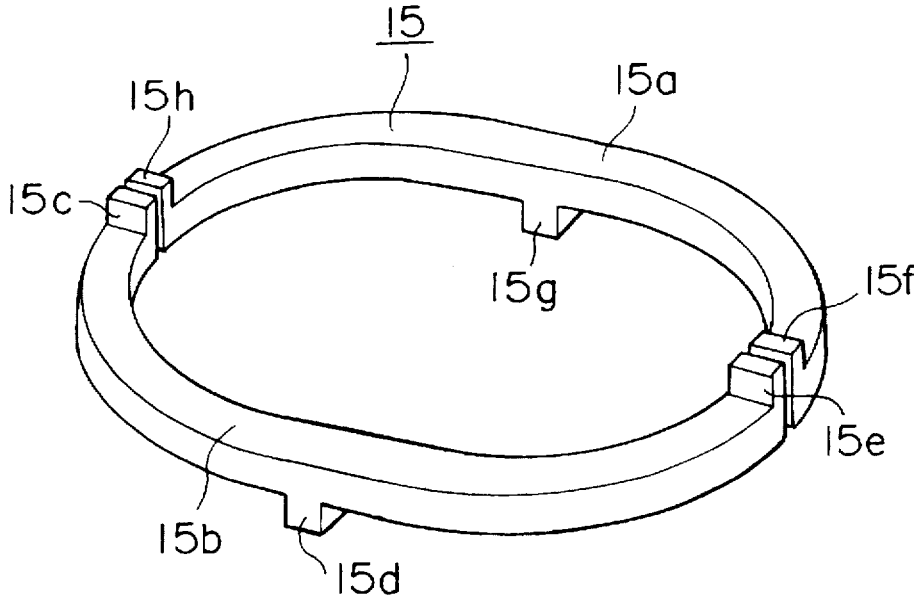
FIG. 2 is a perspective view of an Oldham's coupling used in the first embodiment in FIG. 1.
Figure 3:
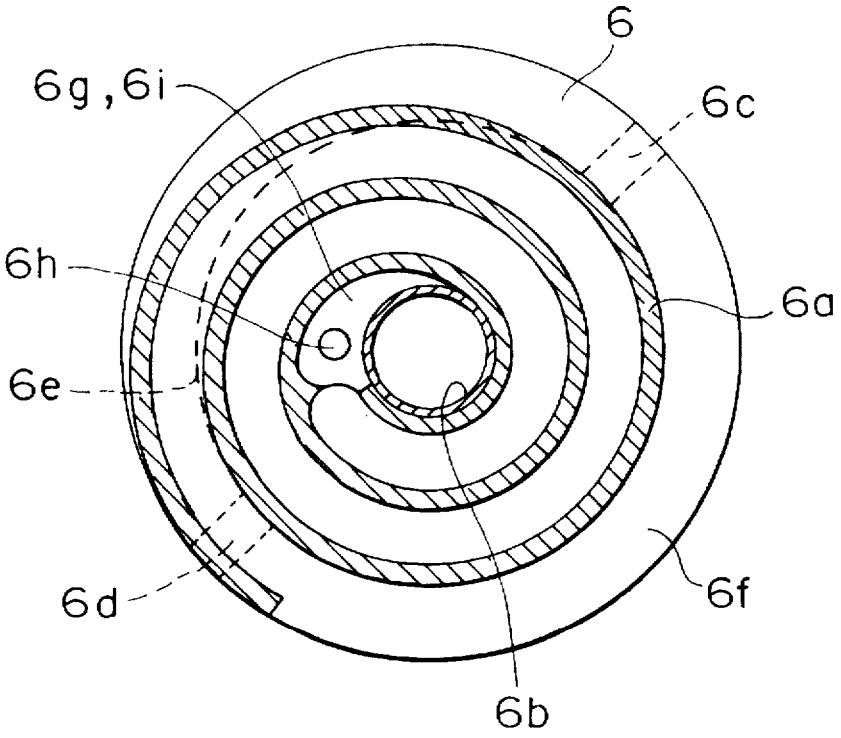
FIG. 3 is a horizontal sectional view of an orbiting scroll used in the first embodiment in FIG. 1.

As shown in FIG. 2, the Oldham's coupling 15 is formed in an elliptical ring shape with two ring portions 15*a*, 15*b* facing each other, including six keys 15*c*, 15*d*, 15*e*, 15*f*, 15*g* and 15*h*. The key pairs 15*c*, 15*h* and 15*e*, 15*f* are butted together on the end faces of the width side so that the two ring portions 15*a*, 15*b* can face each other. The keys 15*d*, 15*g* are engaged with key grooves 6*c*, 6*d* formed in the orbiting scroll 6, respectively, as shown in FIG. 3, and this allows the orbiting scroll 6 to slide relatively along the key grooves. On the other hand, the key pairs 15*c*, 15*h* and 15*e*, 15*f* are engaged with key grooves 5*b*, 5*c* formed in the second fixed scroll 5, respectively, as shown in FIG. 4, and this allows the Oldham's coupling 15 to slide relatively along the key grooves.

In the Oldham's coupling 15 composed of the ring portions 15*a*, 15*b*, the small diameter area is accommodated in a concave groove portion 6*e* in the center of the panel of the orbiting scroll 6, the groove portion 6*e* extending from the outer circumferential surface toward the axis, to slide relatively along the key grooves; whereas the large diameter area protrudes beyond the edge of the panel and the key pairs 15*c*, 15*h* and 15*e*, 15*f* are engaged with the key grooves 5*b*, 5*c* of the second fixed scroll 5, respectively, to slide toward the key grooves.

In the orbiting scroll 6, as shown in FIG. 3, in which only the wrap 6*a* opposite to the first fixed scroll 5 is shown, the first turn of the wrap 6*a*, i.e., the core of the wrap 6*a* is formed into an arc; whereas the last turn, i.e., end portion of the outer curve of the wrap 6*a* comes close to or coincide to the outer edge of the panel 6*f*. By taking such a shape, the panel 6f of the orbiting scroll 6 can be reduced in size with respect to the number of turns of the wrap 6a. Then, discharge passages 6g, 6i and a discharge through-hole 6h are provided at an inner portion of the wrap 6a and the discharge passages 6g, 6i formed axially on the opposite sides of the orbiting scroll 6, i.e., on the upper and lower sides of the orbiting scroll 6 in FIG. 1, in communication with each other by the discharge through hole 6h.

Figure 4:
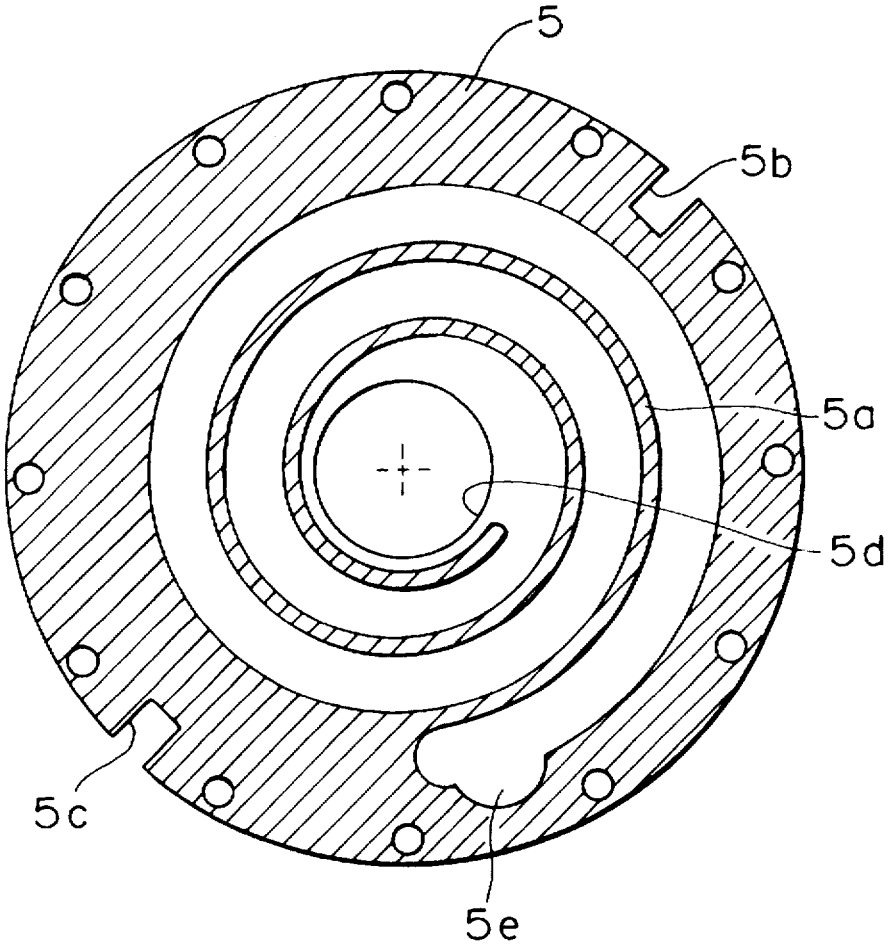
FIG. 4 is a horizontal sectional view of a second fixed scroll used in the first embodiment in FIG. 1.

In the second fixed scroll 5, as shown in FIG. 4, the first turn (inner end) and the last turn (outer end) of the wrap 5a are formed into arcs. Then, an insertion hole 5d is provided inwardly nearby the first turn of the wrap 5a, whereas a suction passage 5e is provided outwardly nearby the last turn of the wrap 5a.

Figure 5:
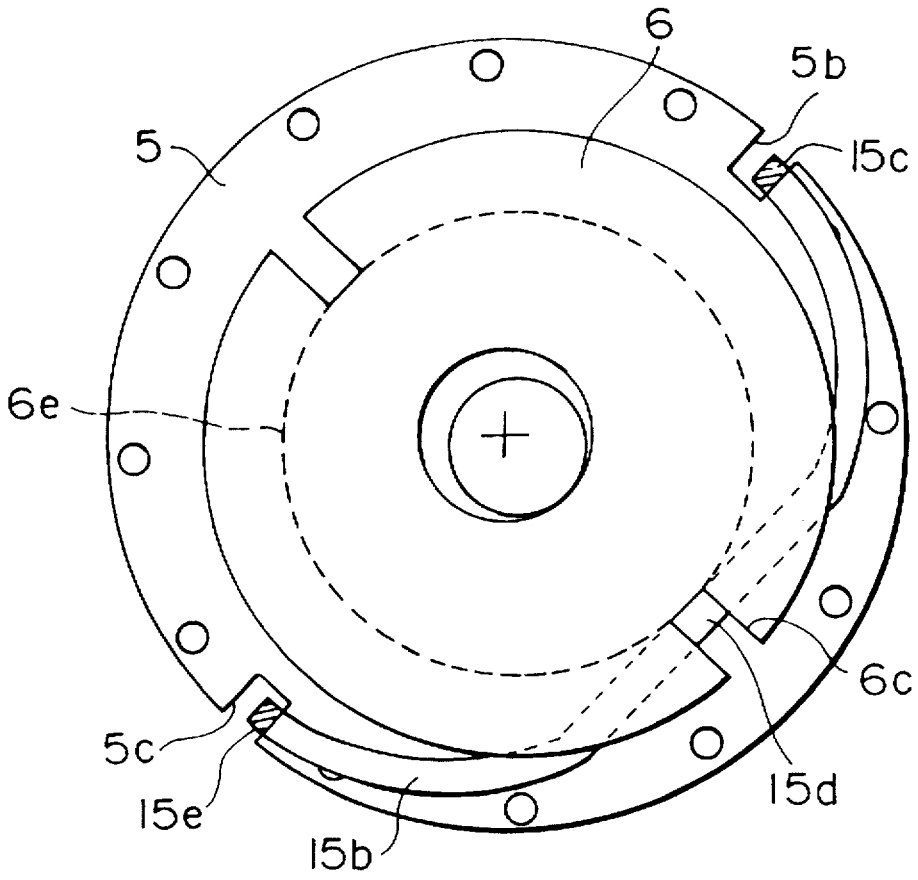
FIG. 5 is a horizontal sectional view showing a state in which the second fixed scroll, the orbiting scroll and the Oldham's coupling are combined.

FIG. 5 shows a state that the second fixed scroll 5, the orbiting scroll 6 and the Oldham's coupling 15 are assembled, as viewed from the first fixed scroll 4 (where only one ring portion of the Oldham's coupling is shown). Here, the wraps are omitted for clarification purpose. As shown in FIG. 5, the Oldham's coupling 15 is accommodated in the concave groove portion 6e formed on the panel outer circumferential surface of the orbiting scroll 6, and the key 15d is engaged with the key groove 6c. On the other hand, the keys 15c, 15e are engaged with the key grooves 5c, 5b of the second fixed scroll 5, respectively. As apparent from the drawing, the Oldham's coupling 15 must be divided to be incorporated into the scrolls.

Figure 6:
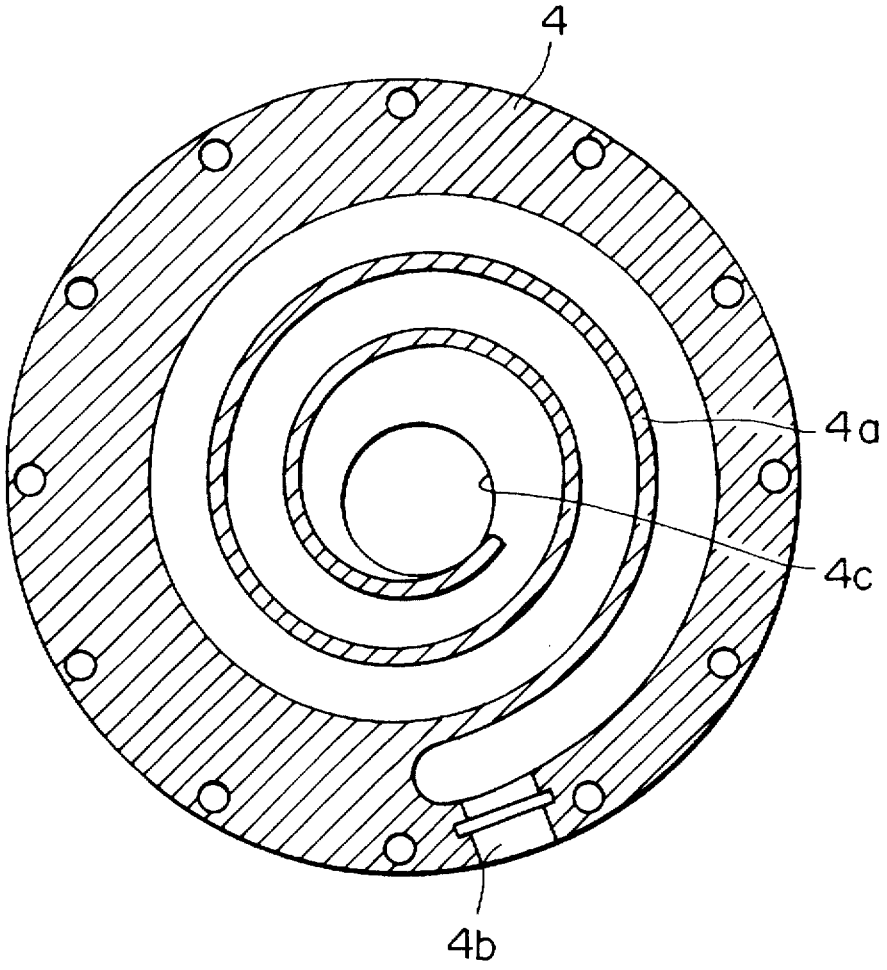
FIG. 6 is a horizontal sectional view of a first fixed scroll used in the first embodiment in FIG. 1.

In the first fixed scroll 4, as shown in FIG. 6, an inlet 4b is provided nearby the last turn (outer end) of the wrap 4a for communicating the suction pipe 9 provided through the side wall of the closed container 1, whereas a discharge through-hole 4c is provided nearby the first turn (inner end) of the wrap 4a to be open to the discharge passage 6g axially formed at one end of the orbiting scroll 6 (on the upper end face in FIG. 1). The discharge through-hole 4c is in communication with a discharge space 1a in the upper portion of the closed container 1 by a discharge passage 2c provided through the first frame 2.

The wraps 6a of the orbiting scroll 6, the wrap 4a of the first fixed scroll 4 and the wrap 5a of the second fixed scroll 5 define compression chambers 16, 17 that communicate with the discharge passages 6g, 6i, respectively.

In such an arrangement of the scroll compressor, a fluid to be compressed is sucked from the suction pipe 9 and compressed in the compression chambers 16, 17 when the orbiting scroll 6 is driven by the crank shaft 8. The compressed fluid is discharged at a redetermined pressure (discharge pressure) from the discharge passage 2a through the discharge passages 6g, 6i and the discharge through-holes 6h, 4c to the discharge space la in the upper portion of the closed container 1 and outside of the closed container 1 through the discharge pipe 10.

Next, a description will be made to a release mechanism of the first and second fixed scrolls 4, 5 required when the pressure in the compression chambers 16, 17 increases excessively, or the liquid compression is occurred.

The first fixed scroll 4 is fitted into the first frame 2 in the following manner: a ring-shaped convexity 4e with a seal ring 4d attached thereto, which is formed on the outside face of the first fixed scroll 4, is slidably fitted into a ring-shaped concavity 2b on the inside face of the first frame 2, with a ring-shaped operation chamber 18 formed between the concavity 2b and the convexity 4e.

On the other hand, the second fixed scroll 5 is fitted into the second frame 3 in the following manner: a ring-shaped convexity 3c with a seal ring 3b attached thereto, which is formed on the inside face of the second frame 3, is slidably fitted into a ring-shaped concavity 5f on the outside face of the second fixed scroll 5, with a ring-shaped operation chamber 19 formed between the concavity 5f and the convexity 3c.

The operation chambers 18, 19 are in communication with the compression chambers 16, 17 by the through-holes 4f, 5g provided through the first and second fixed scrolls 4, 5, respectively. The pressure in the operation chambers 18, 19 can be freely determined by positioning the through-holes 4f, 5g with respect to the compression chambers 16, 17, such as to be an intermediate pressure or suction pressure.

A side surface in the axial direction of a circumferential edge portion of the panel of the second fixed scroll 5 and butting surfaces of circumferential edge portions of the first and second frames 2, 3 are worked and assembled so that axial dimensions becomes the same within a certain tolerance on machining. In this condition, when the orbiting scroll 6 is built into the second fixed scroll 5 (where the panel of the orbiting scroll 6 is in contact with the panel of the second fixed scroll 5), a proper space will be created, in view of performance and reliability, between the wrap tip 6a of the orbiting scroll 6 and the wrap tip 5a of the second fixed scroll 5.

In other words, the length of the wrap 6a of the orbiting scroll 6 is determined based on the length of the wrap 5a of the second fixed scroll 5 by setting a proper space therebetween in view of performance and reliability. Similarly, the relative wrap lengths are determined between the first fixed scroll 4 and the orbiting scroll 6. It should be noted that the panel of the first fixed scroll 4 must be in contact with the panel of the second fixed scroll 5 on the respective side faces in the outer circumference edge portions. Thus, the axial size of the assembly is determined based on the size of side face in the outer circumference edge portion of the second fixed scroll 5.

Next, a reference will be made to a space between the wrap tip 6a of the orbiting scroll 6 and the wrap tip 5a of the second fixed scroll 5 during operation of the compressor. For the sake of simplicity, only the relation between the orbiting scroll 6 and the second fixed scroll 5 is described.

The second fixed scroll 5 is pushed up, i.e., pressed to the orbiting scroll 6 due to a combination of the following axial forces: (1) a force F1 obtained by multiplying the axially projected area of a space 5h by the discharge pressure, the space 5h formed in the center of the second fixed scroll 5 between the crank shaft 8 and the wall surface of the ring-shaped concavity 5f; (2) a force F2 obtained by multiplying the axially projected area of the operation chamber 19 by the pressure therein; and (3) a force F3 obtained by multiplying the axially projected area of a space 20 by the suction pressure, the space 20 formed between the wall surface of the ring-shaped concavity 5f and the second frame 3.

Meanwhile, the second fixed scroll 5 is pushed down, i.e., released from the orbiting scroll 6 due to a compressing force F4 in the compression chamber 17. Consequently, a differential force between the resultant force of F1–F3 and the force F4 causes a shift of the second fixed scroll 5. The forces F1, F3 and F4 are determined from the compressor's operating conditions, so that the space between the wrap tips of the orbiting scroll 6 and the second fixed scroll 5 is determined in accordance with the strength of the force F2. In other words, the orbiting scroll 6 and the second fixed scroll 5 can be arranged with a proper space determined based on the force F2, i.e., the axially projected area of the operation chamber 19 and the pressure in the operation chamber 19.

Next, operation of the scroll compressor will be described. When operating such a scroll compressor, the relationship of the forces F1–F3 to the force F4 are generally set to F1+F2+F3≧F4, so that the panel side faces in the outer circumference edge portions of the first and second fixed scrolls 4, 5 are in slidable contact with the panel side face in the outer circumference edge portion of the orbiting scroll 6, while keeping proper (set) spaces between the wrap tip 6*a* of the orbiting scroll 6 and the wrap tips 5*a*, 4*a* of the first and second fixed scrolls 4, 5, respectively.

Under this condition, if the liquid compression is occurred or the pressure in the compression chambers increases excessively, the relationship of the forces F1–F3 to the force F4 becomes F1+F2+F3<F4, and the first and second fixed scrolls 4, 5 tend to be separate from the orbiting scroll 6. In other words, the side faces in the outer circumference edge portions of the first and second fixed scrolls 4, 5 are axially withdrawn to release the slidable contact of the orbiting scroll 6 with the first and second fixed scrolls 4, 5, so that the space between the wrap tips increases to create a pressure-leakage path from the high to the low, thus reducing the pressure to avoid an excessive pressure rise.

Accordingly, since there is no need to make the fixed scrolls 4, 5 and the orbiting scroll 6 thick members endurable to the abnormal high pressure, they can be formed into thin members as long as they can withstand a required pressure, resulting in a compact, light-weight compressor.

Although the first fixed scroll 4 and the second fixed scroll 5 are axially released in this embodiment, the present invention is not limited thereto and several modifications are possible. For example, the first fixed scroll 4 may be formed with the first frame 2 in one member and fixed to the other member, while only the second fixed scroll 5 is axially released.

As described above, according to the embodiment, the last turn, i.e., the end of the external curve of the wrap 6*a* comes close to or coincides to the outer edge of the panel of the orbiting scroll 6, so that the panel size of the orbiting scroll 6 can be reduced.

Also, the Oldham's coupling 15 is constituted by coupling two ring portions divided in the center of the key width and the ring portions 15*a*, 15*b* are slidably accommodated in the concavity 6*e* formed in an axial center of the panel of the orbiting scroll 6, thereby reducing the size of the compressor.

Further, either or both of the first fixed scroll 4 and the second fixed scroll 5 are released axially from the orbiting scroll 6, so that the compressor can be operated while keeping a proper space between the wrap tip of the orbiting scroll 6 and the wrap tips of the first and second fixed scrolls 4, 5, and so that, when liquid compression or an excessive pressure rise occurs in the compression chambers, the fixed scrolls 4, 5 can be released from the orbiting scroll 6, thereby avoiding an excessive load in the contacting area where the fixed scrolls 4, 5 are in slidably contact with the orbiting scroll 6 on the outer side faces of the outer circumference edge portions of the respective panels.

When the motor for driving the orbiting scroll 6 runs at a high speed (e.g., 6,000 to 9,000 rpms) under control of an inverter in order to perform wide range power control by means of a compact compressor, large centrifugal force is created due to a rotational motion of the orbiting scroll 6. The centrifugal force is canceled by the lower balance weight 13, but a moment around the second frame bearing 3*a* is generated on the crank shaft 8. According to the above embodiment, the moment is canceled by the upper balance weight 14, thereby reducing vibrations even in high-speed operation.

Figure 7:
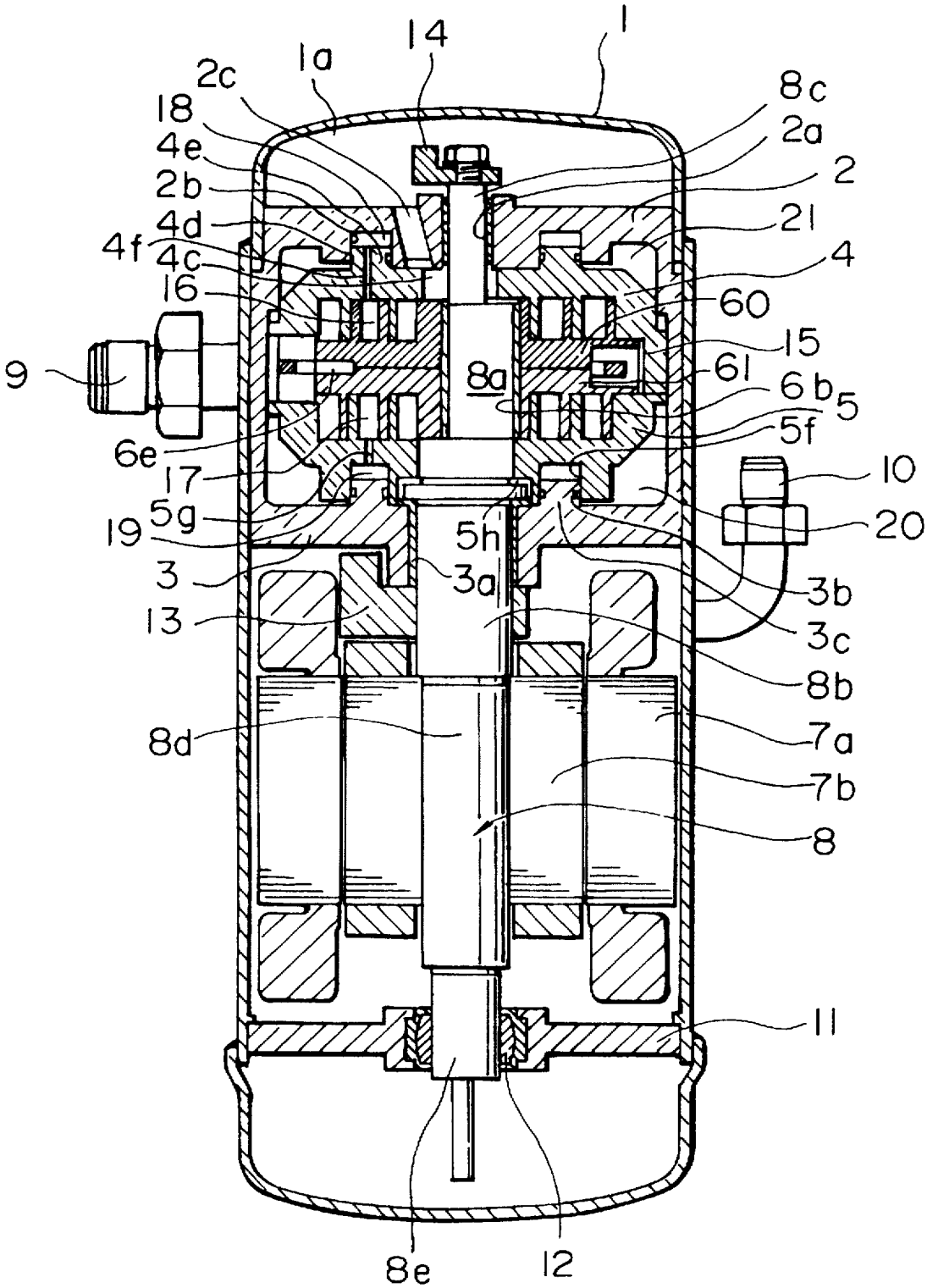
FIG. 7 is a vertical sectional view showing a second embodiment of a scroll compressor according to the present invention.
Figure 8:
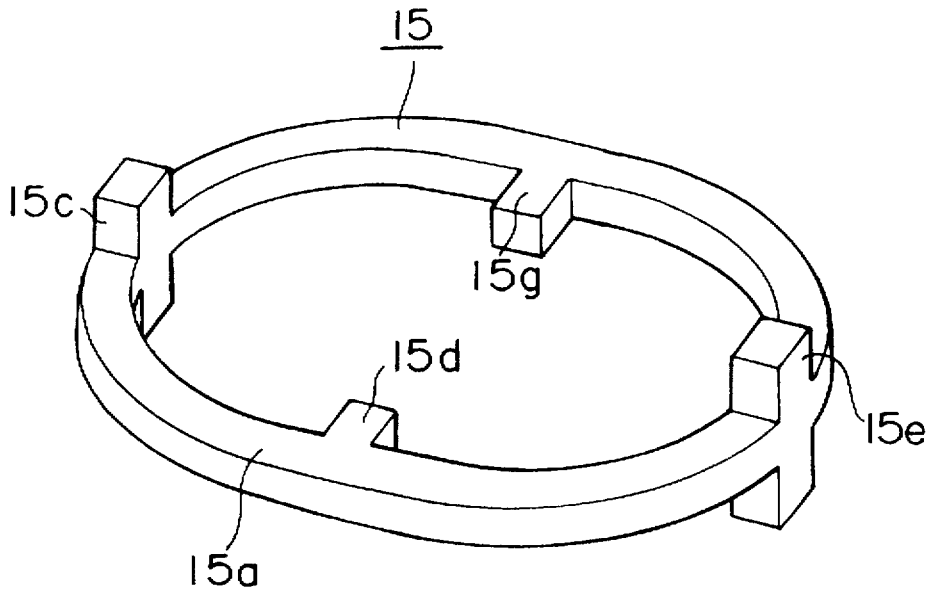
FIG. 8 is a perspective view of an Oldham's coupling used in the second embodiment in FIG. 7.

Then, another embodiment of a scroll compressor according to the present invention will be described with reference to FIG. 7 and FIG. 8. Portions common to those of the first embodiment in FIGS. 1 to 6 are given the same reference numbers and the descriptions thereof are omitted.

A point in which the second embodiment differs from the first embodiment is a structure in which the orbiting scroll is axially divided into two parts. A first orbiting scroll 60 is provided in opposite to the first fixed scroll 4 and a second orbiting scroll 61 is provided in opposite to the second fixed scroll 5. The ring portion 15*a* of the Oldham's coupling 15 is slidably accommodated in a concavity 6*e* formed between the first orbiting scroll 60 and the second orbiting scroll 61 to prevent both the orbiting scrolls 60, 61 from turning on their axes. The Oldham's coupling 15 is constituted of one ring portion 15*a* and four keys 15*c*, 15*d*, 15*e* and 15*g*. The keys are slidably engaged with corresponding key grooves in the first orbiting scroll 60, second orbiting scroll 61, first fixed scroll 4 and second fixed scroll 5.

The most important merit to provide wraps on the both sides of the orbiting scroll is that axial thrust loads generated when fluid to be compressed is compressed are canceled by each other and prevention of deformation to the orbiting scroll panel due to a compressive load. For an orbiting scroll having a wrap on one side, a panel must be thick in order to prevent the panel deformation. However, when an orbitting scroll is made like this embodiment, the upper and lower orbiting scrolls 60, 61 regulate their deformations with each other so that the panel of each orbiting scroll 60, 61 can be remarkably reduced in thickness.

In this embodiment, since the release mechanism and operation of the fixed scrolls 4, 5 are the same as in the first embodiment, the descriptions thereof are omitted.

According to the second embodiment, the orbiting scroll is axially divided into two orbiting scrolls 60, 61 so that the Oldham's coupling can be formed into one body, thereby reducing the size of the compressor as well as improving easiness of assembling. Further, the panel of each orbiting scroll 60, 61 can be made thin.

Figure 9:
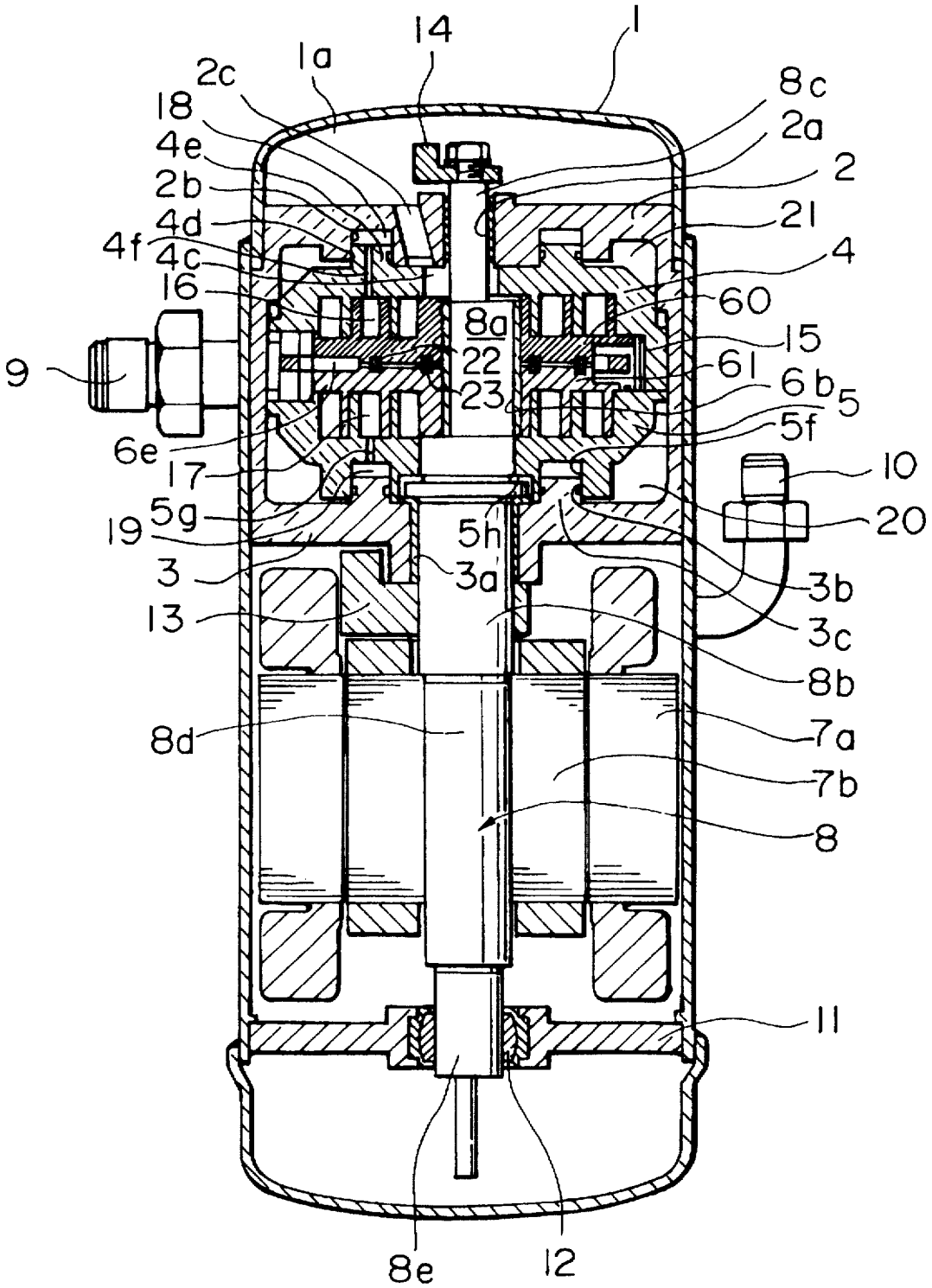
FIG. 9 is a vertical sectional view showing a third embodiment of a scroll compressor according to the present invention.

Then, a third embodiment of a scroll compressor according to the present invention will be described with reference to FIG. 9. Portions common to those of the first and second embodiments are given the same reference numbers and the descriptions thereof are omitted.

The scroll compressor according to the third embodiment is characterized in that the first and second scrolls 60, 61 are arranged to face each other with a proper space on the back faces (opposite faces to the wrap sides) through elastic supporting members 22, 23 with rectangular cross sections. The elastic supporting members 22, 23 made of an elastic, self-lubricating material are put in ring-shaped grooves formed in the first and second orbiting scrolls 60, 61. The elastic supporting members 22, 23 may be made of other type of materials than the self-lubricating one since the first and second orbiting scrolls 60, 61 are not relatively rotated.

In view of performance and reliability, setting of a space between the wrap tips is the most important factor not only in the scroll compressor of double-sided wrap type like the embodiment but also in a scroll compressor of one-sided wrap type. In other words, the efficiency of the compressor is affected by how small the space between the wrap tips have been set without reducing the reliability (durability) during operation of the compressor. Although the release mechanism of the fixed scrolls 4, 5 can be used to meet such a requirement in the art, as discussed in the above embodiments, this embodiment provides a structure in which the orbiting scrolls are moved to be released from the fixed scrolls.

Since the elastic supporting members 22, 23 are made of an elastic, self-lubricating material or the like, when a force tends to release the first and second orbiting scrolls 60, 61 from the first and second fixed scrolls 4, 5 is generated, the back faces (opposite faces to the wrap sides) of the first and second orbiting scrolls 60, 61 are forced to compress the elastic supporting members 22, 23, thus releasing the first and second orbiting scrolls 60, 61 axially from the first and second fixed scrolls 4, 5.

When the force to separate the first and second orbiting scrolls 60, 61 from the first and second fixed scrolls 4, 5 is reduced and the elastic force of the elastic supporting members 22, 23 becomes larger than the force, the first and second orbiting scrolls 60, 61 are pressed to the first and second fixed scrolls 4, 5 to return the original state. As such above, since the elastic supporting members 22, 23 are provided between the back faces of the first and second orbiting scrolls 60, 61, the first and second orbiting scrolls 60, 61 can be rotated further stably during operation. The release operation of the first and second fixed scrolls 4, 5 is the same as discussed above, and the description is omitted.

According to the third embodiment, the elastic supporting members 22, 23 are provided between the back faces of the first and second orbiting scrolls 60, 61 formed by axially dividing one orbiting scroll into two parts at the center of the panel, so that both the orbiting scrolls 60, 61 can be rotated further stably. Also, the both orbiting scrolls 60, 61 can be released from the both fixed scrolls 4, 5 to avoid an excessive load in the contacting area, where the orbiting scrolls 60, 61 are slidably in contact with the fixed scrolls 4, 5 on the outer side faces of the respective panels.

In the case where the orbiting scrolls 60, 61 are made to be axially movable to be released from the fixed scrolls 4, 5, the same effect can be obtained even when the fixed scrolls 4, 5 are immovably fixed to the frames 2, 3.

As apparent from the above embodiments, according to the present invention, since the Oldham's coupling is accommodated in the concavity on the outer surface of the panel of the orbiting scroll and engaged with the orbiting scroll, it is possible to reduce the size of the orbiting scroll.

Since the end portion of the external curve of the orbiting scroll's wrap is formed to come close to or coincide to the outer edge of the panel of the orbiting scroll, it is possible to increase the number of turns of wrap even in an orbiting scroll with a relatively small diameter, thereby obtaining a desired compressible characteristic.

Further, since the fixed scrolls and the orbiting scroll are made to be relatively releasable from each other in the axial direction, the orbiting scroll can be rotated stably with a proper space kept between the wrap tips of the orbiting scroll and the fixed scrolls during operation of the compressor, thereby improving the performance of the compressor. Moreover when liquid compression or an excessive pressure rise occurs in the compression chambers, the fixed scrolls or the orbiting scroll can be released from the other to avoid an excessive load in the contacting area on the outer side faces of the respective scroll panels, thereby improving the reliability.

Furthermore, since the drive shaft is provided with both a balance weight for the rotational motion of the orbiting scroll and a balance weight for the moment acting to the drive shaft, centrifugal force created when the orbiting scroll is rotated and the moment on the drive shaft can be canceled by the balance weights, thereby reducing vibrations even in high-speed operation.

What is claimed is:

1. A scroll compressor comprising an orbiting scroll having volute wraps on both sides of a flat plate; fixed scrolls arranged on the both sides of said orbiting scroll, each having a wrap paired face to face with a mating wrap of said orbiting scroll; and a drive shaft provided through said orbiting scroll and said fixed scrolls for orbiting said orbiting scroll inside said fixed scrolls, in which said orbiting scroll is provided with an orbiting motion while being prevented from turning round said fixed scrolls so that gas is compressed, wherein a concave groove is provided in said orbiting scroll extending from an outer circumferential edge surface of said orbiting scroll radially inwardly, and an Oldham's coupling is accommodated in the concave groove and engaged with said orbiting scroll so that said orbiting scroll is provided with an orbiting motion while being prevented from turning on its axis.

2. The scroll compressor according to claim 1, wherein said drive shaft is provided with both a balance weight mounted outside of one fixed scroll for the rotational motion of said orbiting scroll and a balance weight mounted outside of the other fixed scroll for the moment acting on said drive shaft.

3. The scroll compressor according to claim 1, wherein an end portion of an outer curve of each wrap of said orbiting scroll comes close to or coincides to an outer edge of the flat plate of said orbiting scroll.

4. The scroll compressor according to claim 1, wherein said Oldham's coupling is divided into two parts at the center of key portions thereof and the divided parts are arranged to face each other.

5. The scroll compressor according to claim 1 wherein the size of said scroll compressor is structured to a diameter of 160 mm or less with a power rating of 5 hp.

6. The scroll compressor according to claim 1, wherein said Oldham's coupling has an elliptical ring shape having large and small diameter portions, the large diameter being larger than a diameter of said orbiting scroll, and the small diameter being smaller than a diameter of said orbiting scroll, and having first keys provided on a first surface at said small diameter portions, said first keys slidably engaging key grooves provided in said orbiting scroll, and having second keys provided on a second surface at said large diameter portions, said second keys slidably engaging key grooves provided in one of said fixed scrolls.

7. The scroll compressor according to claim 6, wherein said Oldham's coupling is divided into two parts at the center of each of said second keys, and the divided parts are arranged to face each other.

* * * * *